US005437478A

United States Patent [19]

Gaines

[11] Patent Number: 5,437,478

[45] Date of Patent: Aug. 1, 1995

[54] GIFT CARD WITH RECEIPT

[76] Inventor: Alfred L. Gaines, 1315 Randolph St., NW., Washington, D.C. 20011

[21] Appl. No.: 886,879

[22] Filed: May 22, 1992

Related U.S. Application Data

[63] Continuation-in-part of Ser. No. 589,596, Sep. 28, 1990, Pat. No. 5,143,279.

[51] Int. Cl.[6] ..... B42D 15/00

[52] U.S. Cl. ..... 283/117; 40/124.1; 283/62; 283/116

[58] Field of Search ..... 283/117, 101, 102, 103, 283/105, 146, 62, 56; 40/124.1; 229/68 R

[56] References Cited

U.S. PATENT DOCUMENTS

| | | | |
|---|---|---|---|
| Re. 33,680 | 9/1991 | Drabish | 283/116 X |
| 459,150 | 9/1891 | Welch | 229/68 R |
| 3,826,422 | 7/1974 | Dickinson | 229/68 R |
| 3,883,069 | 5/1975 | Volkert | 229/68 R |
| 3,899,387 | 8/1975 | O'Brien et al. | 229/68 R |
| 4,826,211 | 5/1989 | Sinnott et al. | 283/117 |
| 4,907,826 | 3/1990 | Versage | 283/117 X |
| 5,098,129 | 3/1992 | Haber | 283/117 X |
| 5,100,179 | 3/1992 | Burden | 283/62 |
| 5,114,187 | 5/1992 | Branch | 283/117 X |

*Primary Examiner*—Paul A. Bell
*Assistant Examiner*—Khan Nguyen
*Attorney, Agent, or Firm*—William L. Klima

[57] ABSTRACT

A greeting card with a receipt for recording a monetary gift. The greeting card preferably includes a detachable receipt for collecting similar receipts for various information retrieval purposes.

18 Claims, 2 Drawing Sheets

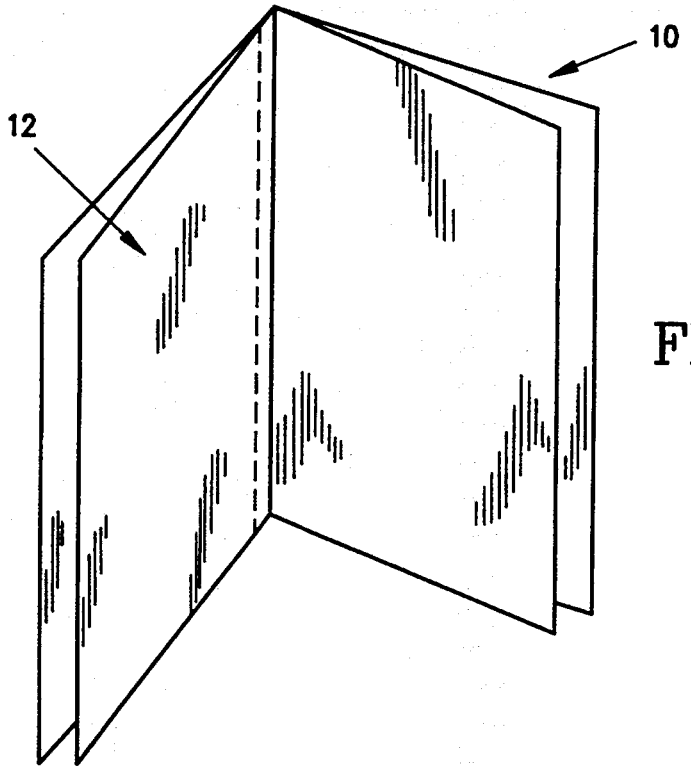
FIG. 1
FIG. 2
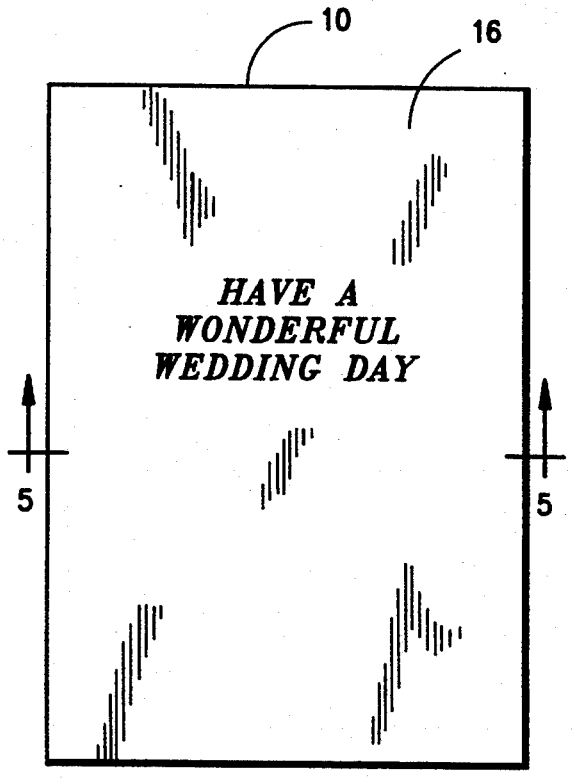
FIG. 3
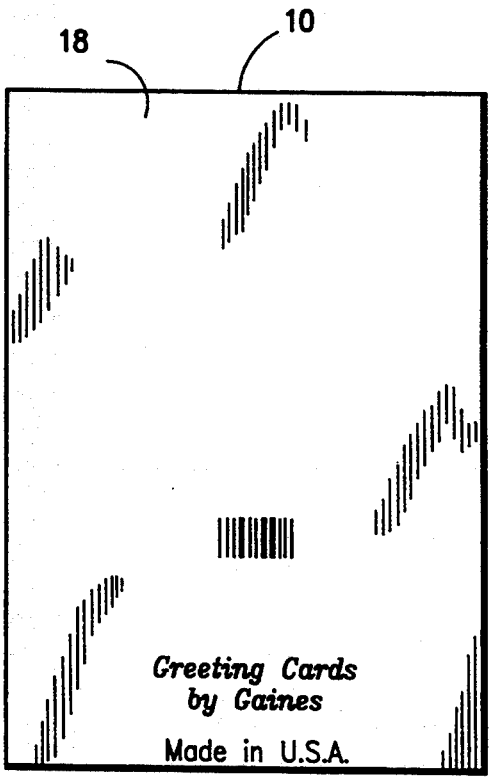

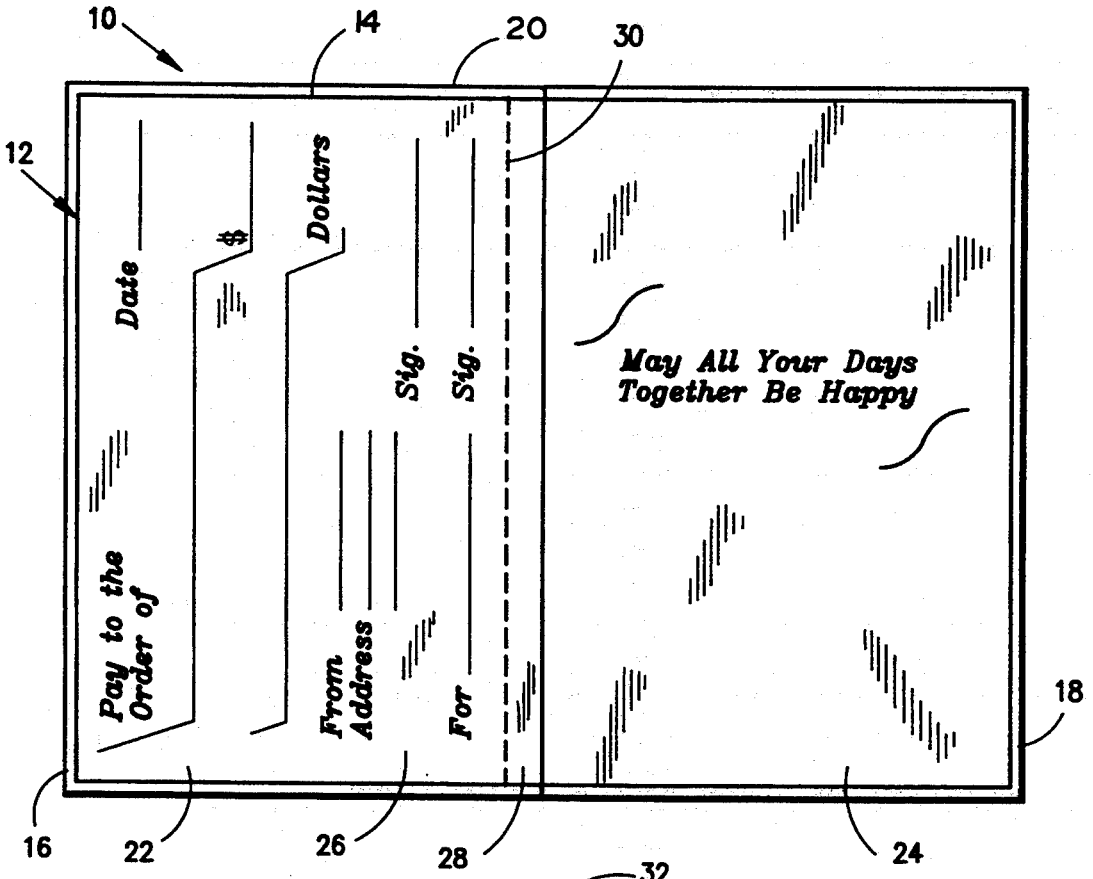
FIG. 4
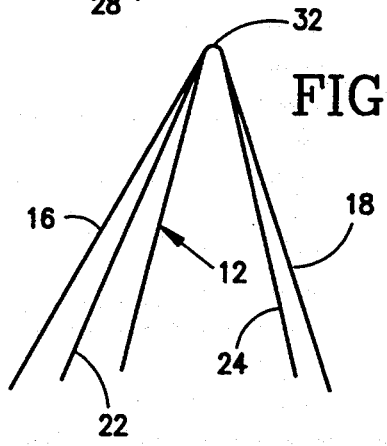
FIG. 6
FIG. 5
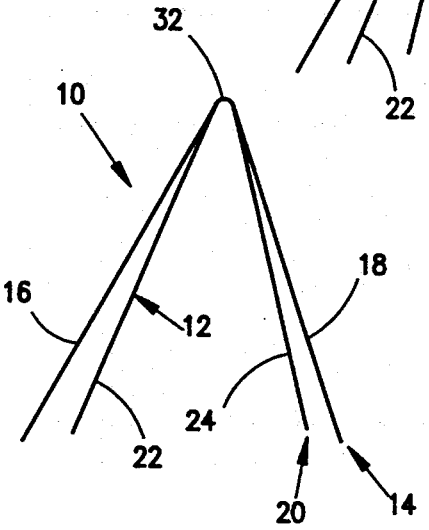
FIG. 7
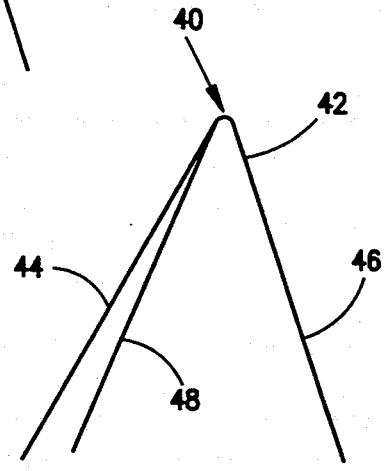

GIFT CARD WITH RECEIPT

RELATED APPLICATION(S)

This is a continuation-in-part of application Ser. No. 07/589,596 filed Sep. 28, 1990 now U.S. Pat. No. 5,143,279.

FIELD OF THE INVENTION

This invention relates to greeting cards such as gift cards containing a receipt for a money gift. More specifically, a card containing a receipt for information including name of person(s) or other entity giving the gift, date of the gift, occasion, amount of the gift, address of the gift giver, telephone number of the gift giver, and/or other related types of information concerning the gift.

BACKGROUND OF THE INVENTION

Gift giving for such occasions as birthdays, weddings, religious occurrences, holidays, anniversaries and the like is a longstanding habit of people in all nations. Generally, such gifts are in the form of material objects which are purchased and gift wrapped and presented with an appropriate greeting card. Often the gift giver doesn't want to give a material gift for such reasons as not knowing what the proposed recipient needs or wants or does not have a sufficiently personal relationship with the proposed recipient to warrant selecting a material gift. In these instances the gift giver usually opts for a monetary gift, a gift particularly appreciated by those just starting a marriage and not yet having determined what they will need or want in establishing their new household.

Monetary gifts are usually in the form of cash or a check. There are bifold greeting cards suitable for the particular occasion which have a cover marking the occasion, an appropriate sentiment on one of the interior faces of the card and a pocket on the opposing face of the card into which the giver places the monetary gift. Once the monetary gift is removed from the pocket, there is no permanent record of the amount of the gift of the giver if the giver did not sign the card which can occur. The retention of such gift cards as memorabilia of the occasion often does not occur despite the occasion unless there was a feature of the card that was noteworthy or from a special giver. As years pass from the occasion, memories of the amount of the gifts become clouded and can result in unnecessary arguments, sometimes acrimonious.

SUMMARY OF THE INVENTION

An object of the present invention is to provide a greeting card with a receipt for a monetary gift.

Another object of the present invention is to provide a greeting card with a detachable receipt for a monetary gift.

A further object of the present invention is to provide a greeting card with a receipt for information including date, name of gift giver, amount of gift, type of monetary gift, address of gift giver, telephone number of gift giver and/or additional related information.

The present invention combines a greeting card with a receipt for recording a permanent record of information concerning the gift. The receipt is preferably detachable from the greeting card to allow it to be saved with other similar gift receipts. This allows a give receiver convenient access to information concerning the gift and gift giver, for example, for use when sending out thank you letters, and for future information retrieval and memorabilia.

BRIEF DESCRIPTION OF THE DRAWINGS

FIG. 1 is a perspective view of a greeting card with receipt according to the present invention;

FIG. 2 is a top plan view of the front of the greeting card;

FIG. 3 a top plan view of the back of the greeting card;

FIG. 4 a front elevational view of the greeting card opened to exhibit an example of a receipt contained therein;

FIG. 5 is a cross-sectional view of the greeting card as illustrated in FIG. 3;

FIG. 6 is a cross-sectional view of another embodiment of a greeting card according to the present invention; and FIG. 7 is a cross-section view of a further embodiment of a greeting card according to the present invention.

DETAILED DESCRIPTION OF PREFERRED EMBODIMENTS

An example of a greeting card 10 with receipt 12 is shown in FIGS. 1–4. The greeting card is illustrated to be in a rectangular configuration, however, other embodiments can have various types of shapes and/or ornamental designs.

The greeting card 10 includes an outer bifold card 14 having a front panel 16, as shown in FIG. 2, and a rear panel 18, as shown in FIG. 3. The front panel 16 typically includes wording and artwork directed to the occasion, and the back panel 18 includes information such as the printer, bar code and other marketing information.

The greeting card 10 includes an inner bifold card 20 positioned within and attached to the outer bifold card 14. The inner bifold card 20 is defined by a front inner panel 22 and a rear inner panel 24, as shown in FIG. 4.

In this embodiment, the receipt 12 is a portion of the front inner panel 22, which receipt 12 is preferably detachable from the greeting card 10 so that it can be stored with other similar receipts. In the embodiment shown in FIG. 4, the receipt 12 is defined as a receipt portion 26 of the front inner panel 22. The receipt portion 26 is detachably connected to a fixed portion 28 attached, which is attached to a main portion of the greeting card 10. In the embodiment illustrated, the fixed portion 28 is a portion of the front inner panel 22, and is attached to the back surface of the front panel 16 with adhesive.

The receipt portion 26 can be detachably connected to the fixed portion 28 by a number of different methods. In the illustrated embodiment, a line of perforations 30 is provided to allow the receipt portion 26 to be torn from the fixed portions. Other methods of forming the detachable connection include bonding separate portions by spot adhesive to form the inner front panel 22, serrating the inner front panel 22 partially through the thickness of the paper material to cause a line of weakness to allow tearing, and other known methods for providing such detaching means.

The receipt 12 can be printed in a manner to allow the insertion of various information, as shown in FIG. 4. Specifically, the receipt 12 is printed with fill in the blank line for the name of the gift receiver (i.e. pay to the order of), date, dollar amount (numbers), dollar amount (written), name of gift giver, address of gift giver, purpose of gift (i.e. for), and one or more signatures of the gift giver(s).

The inner bifold card 20 is nested within the outer bifold card 14, as shown in FIG. 5. The inner bifold card 20 is connected along the binding 32 by adhesive and/or staples.

In an alternative embodiment shown in FIG. 6, the greeting card includes an outer bifold card 14' having an outer front panel 16 and an outer rear panel 18'; an inner bifold card 20' having an inner front panel 22' and inner rear panel 24'; and a separate receipt 12'. The inside surface of the inner front panel 22' can be provide with a message and/or other information.

A further embodiment is shown in FIG. 7. The greeting card 40 includes an outer bifold card 42 having a front panel 44 and rear panel 46. A separate receipt 48 is attached to the outer bifold card 42. In this embodiment, only a one panel receipt is provided within the outer bifold card 42.

I claim:

1. A greeting card for containing a gift, comprising:
a first card in the format of a greeting card; and
a second card in the format of a receipt for recording information concerning the gift being contained in the greeting card, said receipt being detachably connected to said first card.

2. A greeting card according to claim 1, wherein said receipt is detachably connected to said card.

3. A greeting card according to claim 1, wherein said first card is defined by an outer bifold card, and said second card in the format of a receipt is defined by a separate inner card detachably connected within said outer bifold card.

4. A greeting card according to claim 3, wherein said inner panel is detachably connected to said outer bifold card.

5. A greeting card according to claim 3, wherein a greeting and said receipt are both exposed side-by-side upon opening said outer bifold card.

6. A greeting card according to claim 3, wherein said inner card is provided with a line of perforations for allowing a receipt portion of said inner card to be detached from a portion of said inner panel connected to said outer bifold card.

7. A greeting card according to claim 3, wherein said first card includes an inner bifold card, said receipt being defined by a portion of said inner bifold card.

8. A greeting card according to claim 7, wherein said inner bifold card includes a receipt panel having a receipt portion detachably connected to a fixed portion.

9. A greeting card according to claim 8, wherein said fixed portion of said receipt panel is attached to said outer bifold card.

10. A greeting card according to claim 1, wherein said card is defined by an outer bifold card and an inner bifold card nested within and connected to said outer bifold card, and said receipt is defined by a receipt panel of said inner bifold card.

11. A greeting card according to claim 10, wherein said receipt panel comprises a receipt portion detachably connected to a fixed potion attached to said outer bifold card.

12. A greeting card according to claim 1, wherein said card is defined by an outer bifold card and an inner receipt panel detachably connected to said outer bifold card.

13. A greeting card according to claim 1, wherein said receipt is in the format of a blank receipt for recording information relating to a negotiable instrument.

14. A greeting card according to claim 13, wherein said said blank receipt is in a format for recording any information relating to a check.

15. A greeting card according to claim 14, wherein said information relates to the date, payee and dollar amount of the check.

16. A greeting card according to claim 15, wherein said information further relates to the payor, payor's address, memo and signature.

17. A greeting card gift package, comprising:
a gift in the form of money or negotiable instrument;
a first card in the format of a greeting card, said gift is contained in said first card when packaged; and
a second card in the format of a receipt for recording information concerning the gift contained in the greeting card, said receipt being detachably connected to said first card.

18. A package according to claim 17, wherein said second card is provided with a line of perforations along one side that is connected to said first card to allow said second card to be ripped out from said first card along said line of perforations.

* * * * *